US010532000B1

(12) United States Patent
De Sapio et al.

(10) Patent No.: US 10,532,000 B1
(45) Date of Patent: Jan. 14, 2020

(54) INTEGRATED PLATFORM TO MONITOR AND ANALYZE INDIVIDUAL PROGRESS IN PHYSICAL AND COGNITIVE TASKS

(71) Applicant: HRL Laboratories, LLC, Malibu, CA (US)

(72) Inventors: Vincent De Sapio, Westlake Village, CA (US); Stephanie E. Goldfarb, Santa Monica, CA (US); Matthias Ziegler, Oakton, VA (US)

(73) Assignee: HRL Laboratories, LLC, Malibu, CA (US)

( * ) Notice: Subject to any disclaimer, the term of this patent is extended or adjusted under 35 U.S.C. 154(b) by 43 days.

(21) Appl. No.: 15/213,393

(22) Filed: Jul. 18, 2016

Related U.S. Application Data

(63) Continuation-in-part of application No. 14/538,350, filed on Nov. 11, 2014, now abandoned.

(60) Provisional application No. 61/987,085, filed on May 1, 2014, provisional application No. 61/903,526, filed on Nov. 13, 2013, provisional application No. 62/196,212, filed on Jul. 23, 2015.

(51) Int. Cl.

| | |
|---|---|
| ***A61H 1/02*** | (2006.01) |
| ***A63B 21/00*** | (2006.01) |
| ***A63B 24/00*** | (2006.01) |
| ***A63B 71/06*** | (2006.01) |
| ***A61H 3/00*** | (2006.01) |

(52) U.S. Cl.

CPC ..... *A61H 1/0237* (2013.01); *A61H 3/00* (2013.01); *A63B 21/00181* (2013.01); *A63B 24/0006* (2013.01); *A63B 24/0075* (2013.01); *A63B 71/0619* (2013.01); *A63B 2024/0015* (2013.01); *A63B 2071/0647* (2013.01); *A63B 2213/00* (2013.01); *A63B 2225/50* (2013.01)

(58) Field of Classification Search

None

See application file for complete search history.

(56) References Cited

U.S. PATENT DOCUMENTS

| | | | | |
|---|---|---|---|---|
| 2012/0021391 | A1 | 1/2012 | Elsmore | |
| 2013/0198625 | A1 * | 8/2013 | Anderson ..... | G06F 3/016 715/701 |

(Continued)

OTHER PUBLICATIONS

Nishikawa, Kiisa, et al. "Neuromechanics: an integrative approach for understanding motor control." Integrative and Comparative Biology 47.1 (2007): 16-54.*

(Continued)

*Primary Examiner* — Scott A. Waldron
*Assistant Examiner* — Kevin W Figueroa
(74) *Attorney, Agent, or Firm* — Tope-McKay & Associates

(57) ABSTRACT

Described is a system for online characterization of biomechanical and cognitive factors relevant to physical rehabilitation and training efforts. A biosensing subsystem senses biomechanical states of a user based on the output of sensors and generates a set of biomechanical data. The set of biomechanical data is transmitted in real-time to an analytics subsystem. The set of biomechanical data is analyzed by the analytics subsystem, and control guidance is sent through a real-time control interface to adjust the user's motions. In one aspect control guidance is sent to a robotic exoskeleton worn by the user to adjust the user's motions.

20 Claims, 5 Drawing Sheets

(56) References Cited

U.S. PATENT DOCUMENTS

2013/0204545 A1* 8/2013 Solinsky ..... G01P 13/00 702/44
2013/0295963 A1 11/2013 Sen
2013/0310979 A1* 11/2013 Herr ..... B62D 57/032 700/258
2015/0133820 A1* 5/2015 Zohar ..... A61B 5/1118 600/595
2016/0005338 A1* 1/2016 Melendez-Calderon ..... G09B 23/32 434/267

OTHER PUBLICATIONS

Ting, Lena H., et al. "Review and perspective: neuromechanical considerations for predicting muscle activation patterns for movement." International journal for numerical methods in biomedical engineering 28.10 (2012): 1003-1014.*
De Sapio, V., J. Warren, O. Khatib, and S. Delp. "Simulating the task-level control of human motion: A methodology and framework for implementation." The Visual Computer 21, No. 5 (Jun. 2005): pp. 289-302.
De Sapio, V., O. Khatib, and S. Delp. "Least action principles and their application to constrained and task-level Problems in robotics and biomechanics." Multibody System Dynamics (Springer) 19, No. 3 (Apr. 2008): pp. 303-322.
Giftthaler, M., and K. Byl. "Increased Robustness of Humanoid Standing Balance in the Sagittal Plane through Adaptive Joint Torque Reduction." Proceedings of the 2013 IEEE International Conference on Intelligent Robots and Systems. 2013, pp. 4130-4136.
HRL Laboratories LLC. "October Monthly Research and Development Technical Status Report for IARPA ICArUS Program, Contract D10PC20021." HRL Laboratories, LLC, 2012, pp. 1-26.
Jercic, P., P.J. Astor, M.T.P. Adam, and O. Hilborn. "A serious game using physiological interfaces for emotion regulation training in the context of financial decision-making." Proceedings of the European Conference of Information Systems. 2012, pp. 1-14.
Khatib, O., E. Demircan, V. De Sapio, L. Sentis, T. Besier, and S. Delp. "Robotics-based synthesis of human motion." Journal of Physiology—Paris 103, No. 3-5 (Sep. 2009): pp. 211-219.
Lee, C., D. Won, M. J. Cantoria, M. Hamlin, and R. D. de Leon. "Robotic assistance that encourages the generation of stepping rather than fully assisting movements is best for learning to step in spinally contused rats." Journal of Neurophysiology 105, No. 6 (Jun. 2011): pp. 2764-2771.
Saglam, C. O., and K. Byl. "Stability and Gait Transition of the Five-Link Biped on Stochastically Rough Terrain Using a Discrete Set of Sliding Mode Controllers." Proceedings of the 2013 IEEE International Conference on Robotics and Automation. 2013, pp. 5675-5682.
Schuurink, E.L., J. Houtkamp, and A. Toet. "Engagement and EMG in Serious Gaming: Experimenting with Sound and Dynamics in the Levee Patroller Training Game." Proceedings of the 2nd International Conference on Fun and Games. 2008, pp. 139-149.
Thelen, D.G., and F.C. Anderson. "Using computed muscle control to generate forward dynamic simulations of human walking from experimental data." Journal of Biomechanics 39 (2006): pp. 1107-1115.
Thelen, D.G., F.C. Anderson, and S.L. Delp. "Generating dynamic simulations of movement using computed muscle control." Journal of Biomechanics 36 (2003): pp. 321-328.
Ziegler, M. D., H. Zhong, R. R. Roy, and V. R. Edgerton. "Why variability facilitates spinal learning." The Journal of Neuroscience 30, No. 32 (Aug. 2010): pp. 10720-10726.
Delp, S.L., Anderson, F.C., Arnold, A.S., Loan, P., Habib, A., John, C.T., Guendelman, E., Thelan, D.G. OpenSim: Open-source software to create and analyze dynamic simulations of movement. IEEE Transactions on Biomedical Engineering, vol. 55, pp. 1940-1950, 2007.
Goldfarb, S., Earl, D., De Sapio, V., Mansouri, M., & Reinbolt, J. (Oct. 2014). An approach and implementation for coupling neurocognitive and neuromechanical models. In Systems, Man and Cybernetics (SMC), 2014 IEEE International Conference, pp. 399-406, IEEE.
V. De Sapio. (2014) An approach for goal-oriented neuromuscular control of digital humans. International Journal of Human Factors Modelling and Simulation, 4(2): pp. 121-144.
V. De Sapio, J. Warren, O. Khatib, and S. Delp. (2005). Simulating the task-level control of human motion: A methodology and framework for implementation. The Visual Computer, 21(5): pp. 289-302.
F. E. Zajac. (1989). Muscle and tendon: properties, models, scaling, and application to biomechanics and motor control. Critical reviews in biomedical engineering, 17(4), pp. 359-411.
Anderson, F. C., & Pandy, M. G. (2001). Dynamic Optimization of Human Walking. Journal Biomechanical Engineering , 123 (5), pp. 381-390.
Anderson, F. C., & Pandy, M. G. (2001). Static and dynamic optimization solutions for gait are practically equivalent. Journal of Biomechanics , 34, pp. 153-161.
Bogacz, R., Brown, E., Moehlis, J., Holmes, P., & Cohen, J. D. (2006). The physics of optimal decision making: a formal analysis of models of performance in two-alternative forced-choice tasks. Psychological review , 113 (4), pp. 100-765.
Crowninshield, R. D., & Brand, R. A. (1981). A physiologically based criterion of muscle force prediction in locomotion. Journal of Biomechanics , 14, pp. 793-801.
Davy, D. T., & Audu, M. L. (1987). A dynamic optimization technique for predicting muscle forces in the swing phase of gait. Journal of Biomechanics , 20 (2), pp. 187-201.
Hopfield, J. J., & Tank, D. W. (1985). "Neural" computation of decisions in optimization problems. Biological cybernetics , 52 (3), pp. 141-152.
Kaplan, M. L., & Heegaard, J. H. (2001). Predictive algorithms for neuromuscular control of human locomotion. Journal of Biomechanics , 34, pp. 1077-1083.
Siciliano, B., & Khatib, O. (Eds.). (2008). Chapter 6, Section 6.6, pp. 143-146, Springer Handbook of Robotics. Springer.
Mansouri, M., & Reinbolt, J. A. (2012). Journal of Biomechanics. A platform for dynamic simulation and control of movement based on OpenSim and MATLAB , 45 (8), pp. 1517-1521.
Neptune, R. R. (1999). Optimization algorithm performance in determining optimal controls in human movement analyses. Journal of Biomechanical Engineering , 121, pp. 249-252.
Selen, L. P., Shadlen, M. N., & Wolpert, D. M. (2012). Deliberation in the motor system: Reflex gains track evolving evidence leading to a decision. The Journal of Neuroscience , 32 (7), pp. 2276-2286.
Thelen, D. G., & Anderson, F. C. (2006). Using computed muscle control to generate forward dynamic simulations of human walking from experimental data. Journal of Biomechanics , 39, pp. 1107-1115.
Thelen, D. G., Anderson, F. C., & Delp, S. L. (2003). Generating dynamic simulations of movement using computed muscle control. Journal of Biomechanics , 36 (3), pp. 321-328.
S. Goldfarb, R. Bhattacharyya, and V. De Sapio, "Coupled Models of Cognition and Action: Behavioral Phenotypes in the Collective," Collective Intelligence 2014, Poster Session, Massachusetts Institute of Technology, pp. 1-4.
Office Action 1 for U.S. Appl. No. 14/538,350, dated Nov. 14, 2016.
Nishikawa, Kiisa, et al. "Neuromechanics: an integrative approach for understanding motor control." Integrative and Comparative Biology 47.1 (2007): pp. 16-54.
Response to Office Action 1 for U.S. Appl. No. 14/538,350, dated Feb. 14, 2017.
Anderson, F.C. and Pandy, M.G. (2001) 'Dynamic optimization of human walking', Journal of Biomechanical Engineering, vol. 123, No. 5, pp. 381-390.
Anderson, F.C. and Pandy, M.G. (2001) 'Static and dynamic optimization solutions for gait are practically equivalent', Journal of Biomechanics, vol. 34, No. 2, pp.153-161.

(56) References Cited

OTHER PUBLICATIONS

Crowninshield, R.D. and Brand, R.A. (1981) 'A physiologically based criterion of muscle force prediction in locomotion', Journal of Biomechanics, vol. 14, No. 11, pp. 793-801.
Davy, D.T. and Audu, M.L. (1987) 'A dynamic optimization technique for predicting muscle forces in the swing phase of gait', Journal of Biomechanics, vol. 20, No. 2, pp. 187-201.
De Sapio, V. (2011) 'Task-level control of motion and constraint forces in holonomically constrained robotic systems', in Proceedings of the 18th World Congress of the International Federation of Automatic Control, pp. 14622-14629.
De Sapio, V. and Park, J. (2010) 'Multitask constrained motion control using a mass-weighted orthogonal decomposition', Journal of Applied Mechanics, vol. 77, No. 4, pp. 041004-1 through 041004-10.
De Sapio, V., Khatib, O., and Delp, S. (2006) 'Task-level approaches for the control of constrained multibody systems', Multibody System Dynamics, vol. 16, No. 1, pp. 73-102.
De Sapio, V., Khatib, O. and Delp, S. (2005) 'Simulating the task-level control of human motion: a methodology and framework for implementation', The Visual Computer, vol. 21, No. 5, pp. 289-302.
Kaplan, M.L. and Heegaard, J.H. (2001) 'Predictive algorithms for neuromuscular control of human locomotion', Journal of Biomechanics, vol. 34, No. 8, pp. 1077-1083.
Khatib, O. (1995) 'Inertial properties in robotic manipulation: an object level framework', International Journal of Robotics Research, vol. 14, No. 1, pp. 19-36.
Khatib, O., Sentis, L., Park, J., and Warren, J. (2004) 'Whole-body dynamic behavior and control of human-like robots', International Journal of Humanoid Robotics, vol. 1, No. 1, pp. 29-43.
Neptune, R.R. (1999) 'Optimization algorithm performance in determining optimal controls in human movement analyses', Journal of Biomechanical Engineering, vol. 121, No. 2, pp. 249-252.
Sentis, L., Park, J. and Khatib, O. (2010) 'Compliant control of multicontact and center-of-mass behaviors in humanoid robots', IEEE Transactions on Robotics, vol. 26, No. 3, pp. 483-501.
Thelen, D.G. and Anderson, F.C. (2006) 'Using computed muscle control to generate forward dynamic simulations of human walking from experimental data', Journal of Biomechanics,vol. 39, No. 6, pp. 1107-1115.
Thelen, D.G., Anderson, F.C. and Delp, S.L. (2003) 'Generating dynamic simulations of movement using computed muscle control', Journal of Biomechanics, vol. 36, No. 3, pp. 321-328.
Office Action 2 for U.S. Appl. No. 14/538,350, dated Jun. 1, 2017.
Response to Office Action 2 for U.S. Appl. No. 14/538,350, dated Aug. 30, 2017.
Office Action 1 for U.S. Appl. No. 14/539,898, dated Sep. 8, 2017.
Response to Office Action 1 for U.S. Appl. No. 14/539,898, dated Feb. 7, 2018.
Carlos Rengifo et al. "Optimal control of a neuromusculoskeletal model: a second order sliding mode solution", 2008 IEEE, pp. 55-60.
Fady Alnajjar et al. "A bio-inspired neuromuscular model to simulate the neuro-sensorimotor basis for postural-reflex-response in Humans", The Fourth IEEE RAS/EMBS International Conference on Biomedical Robotics and Biomechatronics Roma, Italy. Jun. 24-27, 2012, p. 980-985.
Office Action 3 for U.S. Appl. No. 14/538,350, dated Nov. 27, 2017.
Response to Office Action 3 for U.S. Appl. No. 14/538,350, dated Feb. 27, 2018.
Office Action 2 for U.S. Appl. No. 14/539,898, dated May 31, 2018.
Response to Office Action 2 for U.S. Appl. No. 14/539,898, dated Oct. 1, 2018.
Vincent De Sapio, et al., "Task-level approaches for the control of constrained multibody systems," 2006.
Office Action 4 for U.S. Appl. No. 14/538,350, dated Jul. 26, 2018.

* cited by examiner

INTEGRATED PLATFORM TO MONITOR AND ANALYZE INDIVIDUAL PROGRESS IN PHYSICAL AND COGNITIVE TASKS

CROSS-REFERENCE TO RELATED APPLICATIONS

This is a Continuation-in-Part application of U.S. Non-Provisional application Ser. No. 14/538,350, filed in the United States on Nov. 11, 2014, entitled, "An Approach for Coupling Neurocognitive Decision-Making Models with Neuromechanical Motor Control Models," which is a Non-Provisional patent application that claims the benefit of U.S. Provisional Application No. 61/987,085, filed in the United States on May 1, 2014, entitled, "An Approach for Coupling Neurocognitive Decision-Making Models with Neuromechanical Motor Control Models," which are incorporated herein by reference in their entirety. U.S. Non-Provisional application Ser. No. 14/538,350 also claims the benefit of U.S. Provisional Application No. 61/903,526, filed in the United States on Nov. 13, 2013, entitled, "A Goal-Oriented Sensorimotor Controller for Controlling Musculoskeletal Simulations with Neural Excitation Commands," which is incorporated herein by reference in its entirety.

This application ALSO claims the benefit of U.S. Provisional Application No. 62/196,212, filed in the United States on Jul. 23, 2015, entitled "Integrated Platform to Monitor and Analyze Individual Progress in Physical and Cognitive Tasks," which is incorporated herein by reference in its entirety.

BACKGROUND OF INVENTION

(1) Field of Invention

The present invention relates to an integrated platform to monitor and analyze individual progress in physical and cognitive tasks and, more particularly, to an integrated platform to monitor and analyze individual progress in physical and cognitive tasks alongside a robotic exoskeleton.

(2) Description of Related Art

Lower limb and gait rehabilitation is critical because injuries, particularly those resulting in spinal cord damage, frequently have severe impact on the lower extremities. Lower limb rehabilitation techniques have not advanced at the rate of upper limb rehabilitation techniques which are primarily used in stroke recovery. Unlike rehabilitation for upper limb motion, for which seated postures can allow isolation of the upper extremities, rehabilitation for walking involves complex interactions from the entire body and an understanding of the interactions between the sensory input and motor output that dictate gait behavior.

Current robotic therapy systems for rehabilitation are limited in their responsiveness to the patient, and they require that a physical therapist make operational adjustments to the equipment based on patient performance. The physical therapist must gauge variables which are often difficult to quantify, such as patient fatigue or level of engagement and motivation, and then adjust the treatment accordingly.

In addition to cognitive variables, a large set of biomechanical variables (e.g., joint motion, ground and joint reaction forces, muscle and tendon forces) are highly relevant to characterizing patient rehabilitation. This data is often unavailable to the physical therapist or not easily acquired and exploited. Indeed, over the course of therapy with current robotic systems (e.g., the Hocoma Lokomat, a gait therapy device produced by Hocoma, Inc.), the physical therapist receives only limited, readily quantifiable feedback, such as gait kinematics. Current rehabilitation devices do not provide the therapist with rich feedback from online sensor and model-based characterizations of patient performance. Moreover, predictive analysis regarding therapy outcomes is not presented. Such rehabilitation systems provide therapists with limited tools with which to make critical decisions regarding therapy content, duration, and intensity.

Developmental work has been performed in assessing subject cognitive and emotional states from sensed physiological data, but this work has been limited to the domain of serious gaming (see the List of Incorporated Literature References, Literature Reference Nos. 5 and 9), and not rehabilitation or performance enhancement.

Thus, a continuing need exists for a system that is highly responsive to the user and does not require that a physical therapist (or trainer) make operational adjustments to the equipment based on patient performance, which can be difficult to quantify.

SUMMARY OF THE INVENTION

The present invention relates to an integrated platform to monitor and analyze individual progress in physical and cognitive tasks and, more particularly, to an integrated platform to monitor and analyze individual progress in physical and cognitive tasks alongside a robotic exoskeleton. The system comprises one or more processors and a non-transitory computer-readable medium having executable instructions encoded thereon such that when executed, the one or more processors perform multiple operations. A biosensing subsystem senses biomechanical states of a user based on output of a plurality of sensors, resulting in a set of biomechanical data. The set of biomechanical data is transmitted, in real-time, to an analytics subsystem. The analytics subsystem analyzes the set of biomechanical data. Control guidance is sent through a real-time control interface to adjust the user's motions.

In another aspect, control guidance is sent to a robotic exoskeleton worn by the user to adjust the user's motions.

In another aspect, the analytics subsystem comprises a neurocognitive model and a neuromechanical model implemented within a simulation engine to process the set of biomechanical data and predict user outcomes.

In another aspect, the analytics subsystem is accessible via a visual display.

In another aspect, the visual display displays a reference avatar representing the user's current motion and a goal avatar representing desired motion for the user, wherein the goal avatar is overlaid with the reference avatar on the visual display.

In another aspect, at least one recommendation is presented via the visual display to recommend appropriate adjustments to the robotic exoskeleton.

Another aspect includes a method for causing a processor to perform the operations described herein.

Finally, in yet another aspect, the present invention also comprises a computer program product comprising computer-readable instructions stored on a non-transitory computer-readable medium that are executable by a computer having a processor for causing the processor to perform the operations described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
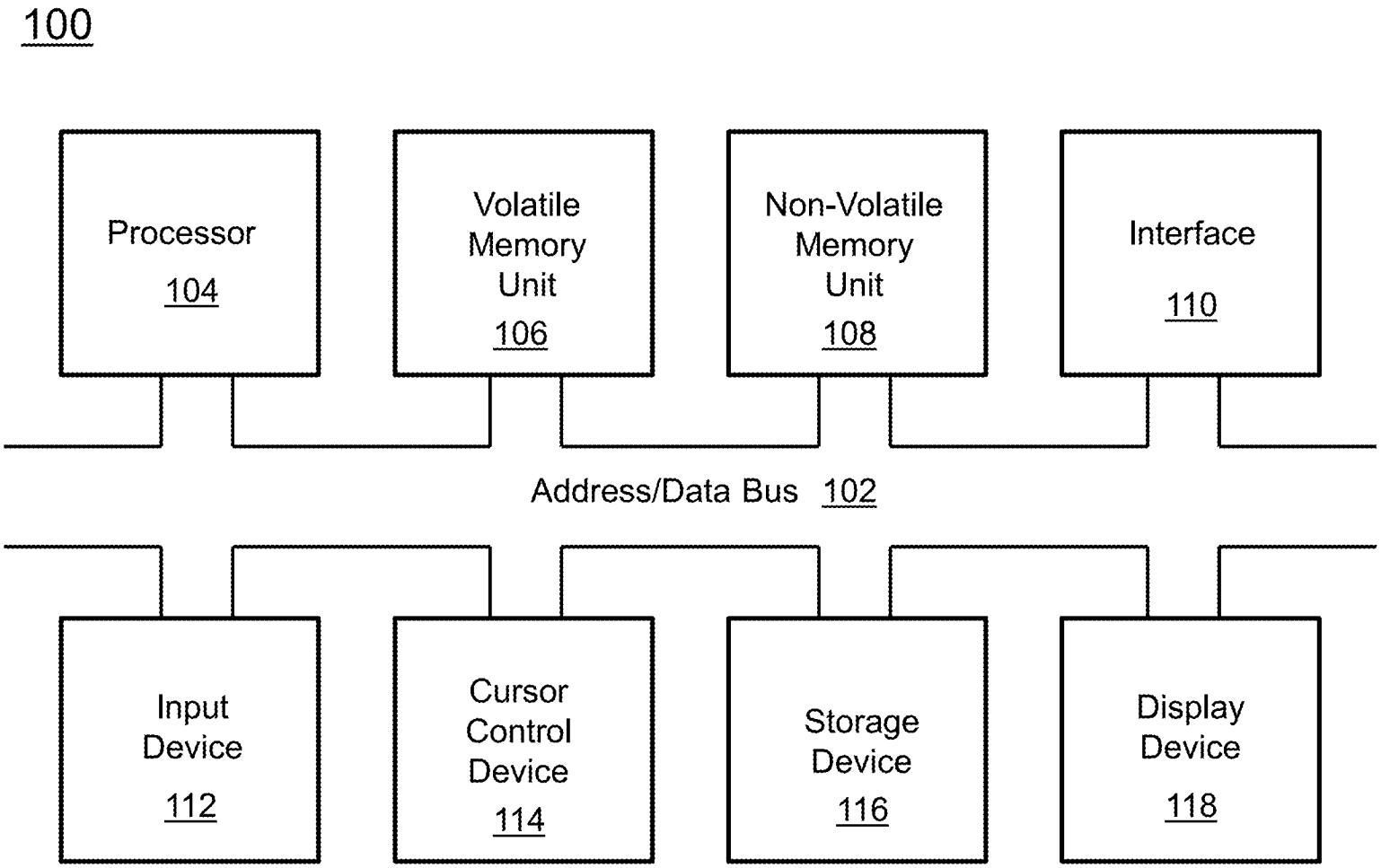
FIG. 1 is a block diagram depicting the components of a system for monitoring and analyzing progress in physical and cognitive tasks according to embodiments of the present invention.

The present invention relates to an integrated platform to monitor and analyze individual progress in physical and cognitive tasks and, more particularly, to an integrated platform to monitor and analyze individual progress in physical and cognitive tasks alongside a robotic exoskeleton. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of aspects. Thus, the present invention is not intended to be limited to the aspects presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter-clockwise have been used for convenience purposes only and are not intended to imply any particular fixed direction. Instead, they are used to reflect relative locations and/or directions between various portions of an object. As such, as the present invention is changed, the above labels may change their orientation.

Before describing the invention in detail, first a list of cited literature references used in the description is provided. Next, a description of various principal aspects of the present invention is provided. Finally, specific details of the present invention are provided to give an understanding of the specific aspects.

(1) LIST OF INCORPORATED LITERATURE REFERENCES

The following references are cited and incorporated throughout this application. For clarity and convenience, the references are listed herein as a central resource for the reader. The following references are hereby incorporated by reference as though fully included herein. The references are cited in the application by referring to the corresponding literature reference number, as follows:

1. De Sapio, V., J. Warren, O. Khatib, and S. Delp. "Simulating the task-level control of human motion: A methodology and framework for implementation." The Visual Computer 21, no. 5 (June 2005): 289-302.
2. De Sapio, V., O. Khatib, and S. Delp. "Least action principles and their application to constrained and task-level problems in robotics and biomechanics." Multibody System Dynamics (Springer) 19, no. 3 (April 2008): 303-322.
3. Giftthaler, M., and K. Byl. "Increased Robustness of Humanoid Standing Balance in the Sagittal Plane through Adaptive Joint Torque Reduction." Proceedings of the 2013 IEEE International Conference on Intelligent Robots and Systems. 2013.
4. HRL Laboratories LLC. "October Monthly Research and Development Technical Status Report for IARPA ICArUS Program, Contract DIOPC20021." HRL Laboratories, LLC, 2012.
5. Jercic, P., P. J. Astor, M. T. P. Adam, and O. Hlilborn. "A serious game using physiological interfaces for emotion regulation training in the context of financial decision-making." Proceedings of the European Conference of Information Systems. 2012.
6. Khatib, O., E. Demircan, V. De Sapio, L. Sentis, T. Besier, and S. Delp. "Robotics-based synthesis of human motion." Journal of Physiology—Paris 103, no. 3-5 (September 2009): 211-219.
7. Lee, C., D. Won, M. J. Cantoria, M. Hamlin, and R. D. de Leon. "Robotic assistance that encourages the generation of stepping rather than fully assisting movements is best for learning to step in spinally contused rats." Journal of Neurophysiology 105, no. 6 (June 2011): 2764-2771.
8. Saglam, C. O., and K. Byl. "Stability and Gait Transition of the Five-Link Biped on Stochastically Rough Terrain Using a Discrete Set of Sliding Mode Controllers." Proceedings of the 2013 IEEE International Conference on Robotics and Automation. 2013.
9. Schuurink, E. L., J. Houtkamp, and A. Toet. "Engagement and EMG in Serious Gaming: Experimenting with Sound and Dynamics in the Levee Patroller Training Game." Proceedings of the 2nd International Conference on Fun and Games. 2008. 139-149.
10. Thelen, D. G., and F. C. Anderson. "Using computed muscle control to generate forward dynamic simulations of human walking from experimental data." Journal of Biomechanics 39 (2006): 1107-1115.

11. Thelen, D. G., F. C. Anderson, and S. L. Delp. "Generating dynamic simulations of movement using computed muscle control." Journal of Biomechanics 36 (2003): 321-328.
12. Ziegler, M. D., H. Zhong, R. R. Roy, and V. R. Edgerton. "Why variability facilitates spinal learning." The Journal of Neuroscience 30, no. 32 (August 2010): 10720-10726.
13. Delp, S. L., Anderson, F. C., Arnold, A. S., Loan, P., Habib, A., John, C. T., Guendelman, E., Thelan, D. G. OpenSim: Open-source software to create and analyze dynamic simulations of movement. IEEE Transactions on Biomedical Engineering, vol 55, pp 1940-1950, 2007
14. Goldfarb, S., Earl, D., De Sapio, V., Mansouri, M., & Reinbolt, J. (2014, October). An approach and implementation for coupling neurocognitive and neuromechanical models. In Systems, Man and Cybernetics (SMC), 2014 IEEE International Conference (pp. 399-406). IEEE.

(2) PRINCIPAL ASPECTS

Various embodiments have three "principal" aspects. The first is a system for monitoring and analyzing progress in physical and cognitive tasks. The system is typically in the form of a computer system operating software or in the form of a "hard-coded" instruction set. This system may be incorporated into a wide variety of devices that provide different functionalities, such as a robot or other device. The second principal aspect is a method, typically in the form of software, operated using a data processing system (computer). The third principal aspect is a computer program product. The computer program product generally represents computer-readable instructions stored on a non-transitory computer-readable medium such as an optical storage device, e.g., a compact disc (CD) or digital versatile disc (DVD), or a magnetic storage device such as a floppy disk or magnetic tape. Other, non-limiting examples of computer-readable media include hard disks, read-only memory (ROM), and flash-type memories. These aspects will be described in more detail below.

A block diagram depicting an example of a system (i.e., computer system 100) of the present invention is provided in FIG. 1. The computer system 100 is configured to perform calculations, processes, operations, and/or functions associated with a program or algorithm. In one aspect, certain processes and steps discussed herein are realized as a series of instructions (e.g., software program) that reside within computer readable memory units and are executed by one or more processors of the computer system 100. When executed, the instructions cause the computer system 100 to perform specific actions and exhibit specific behavior, such as described herein.

The computer system 100 may include an address/data bus 102 that is configured to communicate information. Additionally, one or more data processing units, such as a processor 104 (or processors), are coupled with the address/data bus 102. The processor 104 is configured to process information and instructions. In an aspect, the processor 104 is a microprocessor. Alternatively, the processor 104 may be a different type of processor such as a parallel processor, or a field programmable gate array.

The computer system 100 is configured to utilize one or more data storage units. The computer system 100 may include a volatile memory unit 106 (e.g., random access memory ("RAM"), static RAM, dynamic RAM, etc.) coupled with the address/data bus 102, wherein a volatile memory unit 106 is configured to store information and instructions for the processor 104. The computer system 100 further may include a non-volatile memory unit 108 (e.g., read-only memory ("ROM"), programmable ROM ("PROM"), erasable programmable ROM ("EPROM"), electrically erasable programmable ROM "EEPROM"), flash memory, etc.) coupled with the address/data bus 102, wherein the non-volatile memory unit 108 is configured to store static information and instructions for the processor 104. Alternatively, the computer system 100 may execute instructions retrieved from an online data storage unit such as in "Cloud" computing. In an aspect, the computer system 100 also may include one or more interfaces, such as an interface 110, coupled with the address/data bus 102. The one or more interfaces are configured to enable the computer system 100 to interface with other electronic devices and computer systems. The communication interfaces implemented by the one or more interfaces may include wireline (e.g., serial cables, modems, network adaptors, etc.) and/or wireless (e.g., wireless modems, wireless network adaptors, etc.) communication technology.

In one aspect, the computer system 100 may include an input device 112 coupled with the address/data bus 102, wherein the input device 112 is configured to communicate information and command selections to the processor 100. In accordance with one aspect, the input device 112 is an alphanumeric input device, such as a keyboard, that may include alphanumeric and/or function keys. Alternatively, the input device 112 may be an input device other than an alphanumeric input device. In an aspect, the computer system 100 may include a cursor control device 114 coupled with the address/data bus 102, wherein the cursor control device 114 is configured to communicate user input information and/or command selections to the processor 100. In an aspect, the cursor control device 114 is implemented using a device such as a mouse, a track-ball, a track-pad, an optical tracking device, or a touch screen. The foregoing notwithstanding, in an aspect, the cursor control device 114 is directed and/or activated via input from the input device 112, such as in response to the use of special keys and key sequence commands associated with the input device 112. In an alternative aspect, the cursor control device 114 is configured to be directed or guided by voice commands.

In an aspect, the computer system 100 further may include one or more optional computer usable data storage devices, such as a storage device 116, coupled with the address/data bus 102. The storage device 116 is configured to store information and/or computer executable instructions. In one aspect, the storage device 116 is a storage device such as a magnetic or optical disk drive (e.g., hard disk drive ("HDD"), floppy diskette, compact disk read only memory ("CD-ROM"), digital versatile disk ("DVD")). Pursuant to one aspect, a display device 118 is coupled with the address/data bus 102, wherein the display device 118 is configured to display video and/or graphics. In an aspect, the display device 118 may include a cathode ray tube ("CRT"), liquid crystal display ("LCD"), field emission display ("FED"), plasma display, or any other display device suitable for displaying video and/or graphic images and alphanumeric characters recognizable to a user.

The computer system 100 presented herein is an example computing environment in accordance with an aspect. However, the non-limiting example of the computer system 100 is not strictly limited to being a computer system. For example, an aspect provides that the computer system 100 represents a type of data processing analysis that may be used in accordance with various aspects described herein.

Moreover, other computing systems may also be implemented. Indeed, the spirit and scope of the present technology is not limited to any single data processing environment. Thus, in an aspect, one or more operations of various aspects of the present technology are controlled or implemented using computer-executable instructions, such as program modules, being executed by a computer. In one implementation, such program modules include routines, programs, objects, components and/or data structures that are configured to perform particular tasks or implement particular abstract data types. In addition, an aspect provides that one or more aspects of the present technology are implemented by utilizing one or more distributed computing environments, such as where tasks are performed by remote processing devices that are linked through a communications network, or such as where various program modules are located in both local and remote computer-storage media including memory-storage devices.

Figure 2:
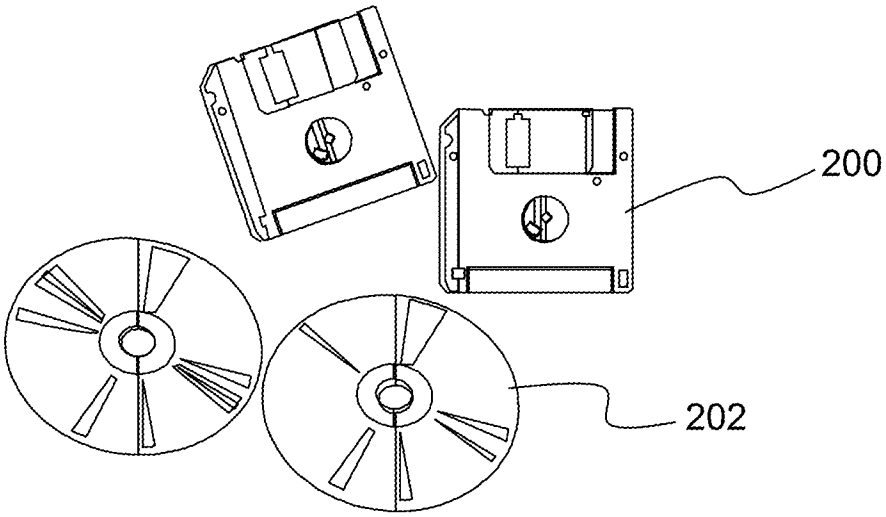
FIG. 2 is an illustration of a computer program product according to embodiments of the present invention.

An illustrative diagram of a computer program product (i.e., storage device) embodying an aspect of the present invention is depicted in FIG. 2. The computer program product is depicted as floppy disk 200 or an optical disk 202 such as a CD or DVD. However, as mentioned previously, the computer program product generally represents computer-readable instructions stored on any compatible non-transitory computer-readable medium. The term "instructions" as used with respect to this invention generally indicates a set of operations to be performed on a computer, and may represent pieces of a whole program or individual, separable, software modules. Non-limiting examples of"instruction" include computer program code (source or object code) and "hard-coded" electronics (i.e. computer operations coded into a computer chip). The "instruction" is stored on any non-transitory computer-readable medium, such as in the memory of a computer or on a floppy disk, a CD-ROM, and a flash drive. In either event, the instructions are encoded on a non-transitory computer-readable medium.

(3) SPECIFIC DETAILS OF THE INVENTION

Described is an integrated platform that provides injured users (e.g., warfighters, athletes, patients) with more effective, custom-tailored therapy by leveraging and integrating rich biomechanical sensing; predictive neurocognitive and neuromechanical models; real-time control algorithms; and state-of-the-art robotic exoskeleton technology. These technical components enable real-time responsiveness to the user by both the physical therapist and the exoskeleton interface.

Figure 3:
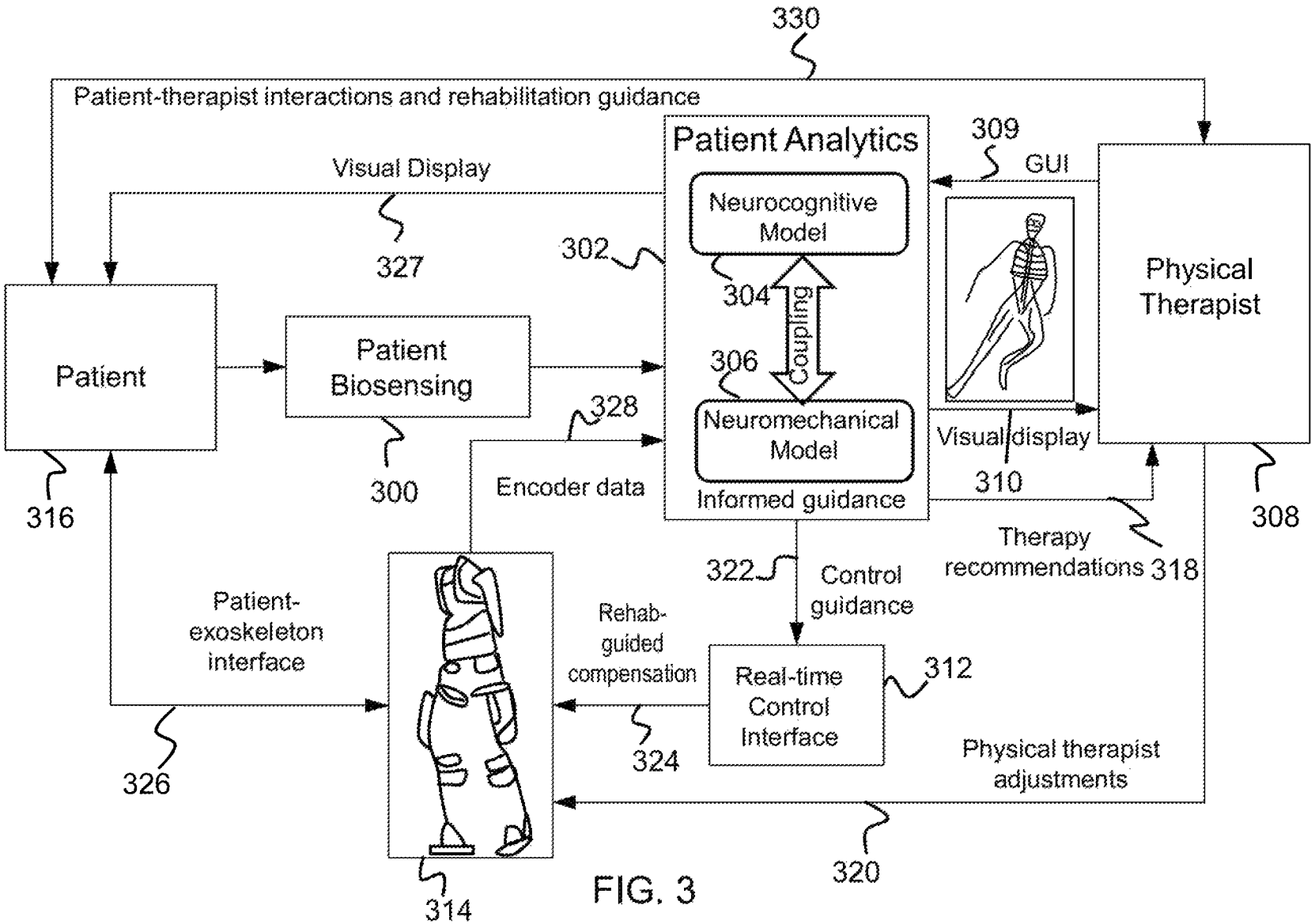
FIG. 3 is an illustration of a patient biosensing subsystem and a patient analytics subsystem according to embodiments of the present invention.

The present invention comprises a platform (i.e., system of integrated hardware and software components) for online characterization of neurocognitive, neuroplastic, sensorimotor, and biomechanical factors relevant to rehabilitation efforts. The platform provides real-time and post-session analysis of the patient's rehabilitation progress to a physical therapist. FIG. 3 illustrates the system architecture according to some embodiments, which includes a patient biosensing subsystem 300 incorporating portable multi-modal physiological sensing technologies, and a patient analytics subsystem 302 comprised of a neurocognitive model 304 and a neuromechanical model 306. The patient analytics subsystem 302 is implemented within a simulation engine to process a sensed biomechanical state, estimate hidden state variables, and predict patient outcomes. The patient analytics subsystem 302 is accessible by a physical therapist 308 via a graphical user interface (GUI) 309, and visual display 310. A real-time control interface 312 provides low-level compensation to a rehabilitation exoskeleton 314 based on ensuring patient safety, and improving rehabilitation progress. The use of the patient analytics subsystem 300 in a direct control interface (i.e., real-time control interface 312) with a robotic exoskeleton 314 speeds rehabilitation progress while ensuring patient safety. In an embodiment of the present invention, the system does not include a robotic exoskeleton. Rather, verbal or visual commands are provided directly to the patient 316 through the real-time control interface 312. In this example, the real-time control interface may present visual or audible instructions to the patient to adjust their motions.

The patient biosensing subsystem 300 incorporates portable multi-modal biomechanical sensing technologies capable of easy setup and use in rehabilitation facilities. The patient biosensing subsystem 300 draws from sensors both external and internal to the exoskeleton 314, and is used to monitor physical, cognitive, and emotional states of the patient 316. The patient biosensing subsystem 300 streams patient data in real-time to the patient analytics subsystem 302.

The patient analytics subsystem 302 is comprised of neurocognitive and neuromechanical models 304 and 306 implemented within a simulation engine (e.g., ACT-R for individualized cognitive models for rehabilitation therapy described in Literature Reference No. 15-17, and OpenSim for biomechanical analysis described in Literature Reference No. 13), which processes the sensed biomechanical state (e.g., kinematics), estimates hidden state variables (e.g., muscle activations, internal joint reaction forces) using sensed states and predictive models (e.g., computed muscle control prediction of muscle activations from measured patient motion), and predicts patient outcomes (e.g., patient progress relative to the rehabilitation goals). Hidden biomechanical state variables that are difficult or impossible to measure (muscle activations, internal joint reaction forces) require estimation using both measured states (e.g., joint motion, ground reaction forces) and a physics-based biomechanical model.

Predictions of patient outcomes are progressively made by comparing direct patient measurements (e.g., gait motion patterns, ground reaction forces) and hidden biomechanical variables computed using the biomechanical model (e.g., muscle activations levels, internal joint torques, reaction forces) from the current session with previous archived sessions. In other words, prediction of patient outcome is made by comparing the direct patient measurements and hidden state estimates with previous archived patient data to give a progress metric. For example, gait rehabilitation would specify certain goals to improve gait for a patient with a lower limb disability. Specifically, in knee flexion/extension associated with stiff knee gait, the patient's therapy session performance, quantified by direct measurements and estimates of states, would be compared to previous sessions as well as a goal template of normal gait. This comparison would quantify how the patients knee flexion/extension (joint motion, activation patterns of flexor/extensor muscles) was improving over time to yield a performance metric of how well the patient was progressing toward the rehabilitation goal.

The patient analytics subsystem 302 is accessible by a physical therapist 308 via the GUI 309. The visual display 310 renders a patient's reference avatar (i.e., an icon or figure representing the patient), mirroring the patient's 316 motion but providing additional data, such as muscle activation patterns mapped as colors on simulated muscles and joint loads mapped as force vector arrows at the joints. The patient's goal avatar is overlaid with the patient's reference avatar. The patient's goal avatar represents desired motion for the patient 316 at his or her stage of rehabilitation. Therapy recommendations 318 (e.g., accelerate or slow down the exercise protocols based on patient progress, change the exercises based on patient progress) can also be presented to the physical therapist 308 via the visual display 310, and the physical therapist 308 can then make appropriate adjustments 320 to the exoskeleton 314.

Another component is the real-time control interface 312 and exoskeleton 314. Control guidance 322 provided by the patient analytics subsystem 302 is input to the real-time control interface 312 which will provide low-level/rehabilitation-guided compensation 324 to the exoskeleton 314 based on ensuring patient 316 safety, and improving rehabilitation progress. This compensation 324 would involve actuating the joints of the exoskeleton in ways consistent with the therapy needs. The control guidance 322 will provide instructions to the rehabilitation exoskeleton 314 that may include, but are not limited to, the amount of assistance/resistance provided during movement to reinforce desired movement and muscle activation patterns versus unwanted movement. The control guidance 322 would also instruct the exoskeleton 314 to prevent movement that would impact patient safety (e.g., resist an impending fall). The exoskeleton 314 and control guidance 322 can be applied to both upper and lower limb rehabilitation (e.g., stroke rehabilitation of arm motor coordination).

Furthermore, a patient-exoskeleton interface 326 provides interaction between the patient 316 and the exoskeleton 314. The exoskeleton 314 can be an existing commercial device, such as an exoskeleton produced by Ekso Bionic, located at 1414 Harbour Way South Suite 1201, Richmond, Calif., 94804. The exoskeleton 314 consists of mechanical links connected by robotically actuated joints that are worn by the patient as an articulated suit and can be controlled by a computer interface. Additionally, access to a second visual display 327 can be provided directly to the patient 316 to present results of the patient analytics subsystem 302 using a goal and reference avatar analagous to the visual display 310 accessible by the physical therapist 308. Encoder data 328, representing the angle of each joint over time, is sent from the exoskeleton 314 to the patient analytics subsystem 302. The encoder data 328 is used, along with any additional biosensing data, by the patient analytics subsystem 302 to estimate hidden (unmeasured) biomechanical variables. Hidden biomechanical variables that are difficult or impossible to measure require estimation using both measured states and a physics-based biomechanical model. Hidden biomechanical variables are derived from measured variables obtained from sensors on, for example, the exoskeleton 314. For example, muscle activations, joint moments, and joint reactions forces are derived from measured patient joint motion and ground reaction forces using computed muscle control predictions. In the absence of an exoskeleton, a vision system near the user could capture biomechanics (e.g., joint mechanics) of the user (e.g., soldier, patient). From measured variables of user motion, estimates of hidden biomechanical variables, such as muscle activation, are calculated. Furthermore, the system allows for patient-therapist interactions and rehabilitation guidance 330. In the absence of an exoskeleton, encoder data 328 could be collected from sensors connected with the user's clothing or body, such as inertial sensors.

FIG. 3 depicts a functional block diagram for the present invention. For the patient biosensing subsystem 300, sensing technologies are evaluated to assess the biomechanical/physiological (e.g., motion capture, force plate, electromyography (EMG), heart rate) and cognitive/emotional state (e.g., opthalmetrics, galvanic skin response) of rehabilitation patients. Evaluation is focused on commercially available systems that provide ease of use for both developer and end-user (i.e., the patient 316 and therapist 308), low cost, portability, and only modest compromises in performance (e.g., accuracy, update rate) relative to custom or research products.

Sensing hardware (e.g., kinematic and inertial sensors, ground reaction force sensors) is used which is both easily configurable and practical for use with the rehabilitation exoskeleton 314. As a non-limiting example, a ground reaction force sensor is located in foot pads within the exoskeleton 314. Kinematic sensors can be built into joints of the exoskeleton 314. Inertial sensors (e.g., inertial measurement units (IMUs)) can be attached to limb segments of the exoskeleton 314. The exoskeleton 314 itself is comprised of joint encoders, which will provide kinematic information (i.e., encoder data 328). Additional sensing is integrated either with the exoskeleton 314, where practical, or used in a standoff setting from the exoskeleton 314. For instance, sensors, such as an electroencephalography (EEG) or electrocardiogram (EKG), can be connected with the user (e.g., soldier, patient). While such additional sensors (e.g., electromyography (EMG)) can provide valuable information, data can also be provided from sensors on the exoskeleton 314 (or easily integrated with it) to minimize cost and maximize flexibility. Sensing components are procured and assembled into the patient biosensing subsystem 300. Sensors that cannot be integrated with the exoskeleton 314 may still be used for testing purposes in a standoff setting; however, they will not be included in the integrated system.

For the patient analytics subsystem 302, a patient neuromechanical model 306 and a patient neurocognitive model 304 have been developed (described in U.S. application Ser. No. 14/538,350 and Literature Reference No. 14). Resources include OpenSim (see Literature Reference No. 13), an existing NIHDARPA funded open-source musculoskeletal simulation environment that will be used for the patient neuromechanical model 306. The neuromechanical simulation is designed to acquire data from the sensing subsystem (i.e., the patient biosensing subsystem 300) and generate estimates of hidden states (e.g., muscle activation states, and other biomechanical states). The computed muscle control algorithm (see Literature Reference Nos. 10 and 11 for a description of the computed muscle control algorithm) is used as a feedback control algorithm for generating biologically plausible muscle excitations to track patient 316 motion (acquired from joint encoders in the patient biosensing subsystem 300). The real-time results from the neuromechanical simulation are provided to the physical therapist 308 on a graphical visual display 310.

The neurocognitive model 304 is designed to acquire data from the sensing subsystem (i.e., the patient biosensing subsystem 300) and provide cognitive state estimates as well as forecasting of patient cognitive performance (e.g., fatigue, motivation, stress, frustration). Cognitive state estimates can be made using, for instance, functional near-infrared spectroscopy (fNIRS) or electroencephalography (EEG). By querying these models and making inferences of motivational state from sensed physiological data (heart, respiration, opthalmetric parameters, galvanic skin response), the physical therapist 308 can make use of the patient's 316 mental and emotional condition during rehabilitation. Again, this is conveyed to the physical therapist 308 via a graphical visual display 310.

Output from the patient biosensing subsystem 300 and the patient analytics subsystem 302 is used to design better rehabilitation-guided compensation 324 for the exoskeleton 314. The initial focus of this feedback is to ensure patient 316 safety. For example, one can flag points at which the patient 316 is at heightened risk for a fall by analyzing changes in the ground reaction force from force plates that are mounted either on the soles of the patients shoes or the exoskeleton foot pads. Loss of footing preceding a fall can be detected by patterns of reduction in measured ground reaction force. In stable gait, there are transitions in ground reaction force between feet as stance and swing legs alternate. Deviations in the stable transition of reaction forces between feet indicate that the patient is at heightened risk of a fall. The real-time control interface 312 can then intervene by using appropriately designed rehabilitation-guided compensation 324 to the exoskeleton 314 in order to prevent a fall or mitigate the consequences of a fall.

The next focus is on improving the stability of the gait of individual patients 316 in real-time. Over use of robotic assistance can lead to disruption of the neural circuitry involved in walking, causing more harm than benefit (see Literature Reference No. 7). Therefore, real-time analysis of the patient's 316 leg movements dictate how the exoskeleton interacts with the patient 316 via the patient-exoskeleton interface 326.

A patient 316 begins rehabilitation with the real-time control interface 312 providing a high level of active control over the patient's 316 legs through the exoskeleton 314; however, as the patient 316 improves, the real-time control interface 312 provides an assist-only-as-needed feedback to the patient 316. As long as the patient 316 maintains his or her gait within a specified tolerance from a desired gait pattern, the exoskeleton 314 provides minimal forces. However, if the patient's 316 gait exhibits high variance from the desired movements, the exoskeleton 314 will provide greater guidance by correcting the motion through application of actuation at the appropriate joints to reinforce proper motion and resist deviations in motion until the patient 316 recovers the desired gait. Literature Reference No. 12 describes how an assist-as-needed training paradigm, providing greater guidance during high gait variability, promotes spinal learning and rehabilitation. The sensors capture greater asymmetries in motion (e.g., deviations between right and left leg in stance and swing phases of motion, deviations in muscle activation between right and left leg in stance and swing phases of motion, deviations in internal joint and external ground reaction forces between right and left leg in stance and swing phases of motion) than the physical therapist's eyes alone, allowing the real-time control interface 312 to adapt rehabilitation-guided compensation 324 to the patient-exoskeleton system accordingly. It is not uncommon for a patient 316 to try to avoid difficult tasks in therapy, and the visual display 310 of the present invention allows the physical therapist 308 to identify and correct lazy and avoidant behaviors which might otherwise have been missed. Lazy and avoidant motions are identified through experience by a trained therapist. They can be distinguished from fatigued motion by the therapist by observing the patient's overall emotional state (e.g., visible straining is indicative of actual fatigue, boredom and disinterest by the patient is indicative of lazy and avoidant behavior). These behaviors can also be distinguished through analysis of the data. Muscle fatigue can be characterized by joint angle variability.

Figure 4:
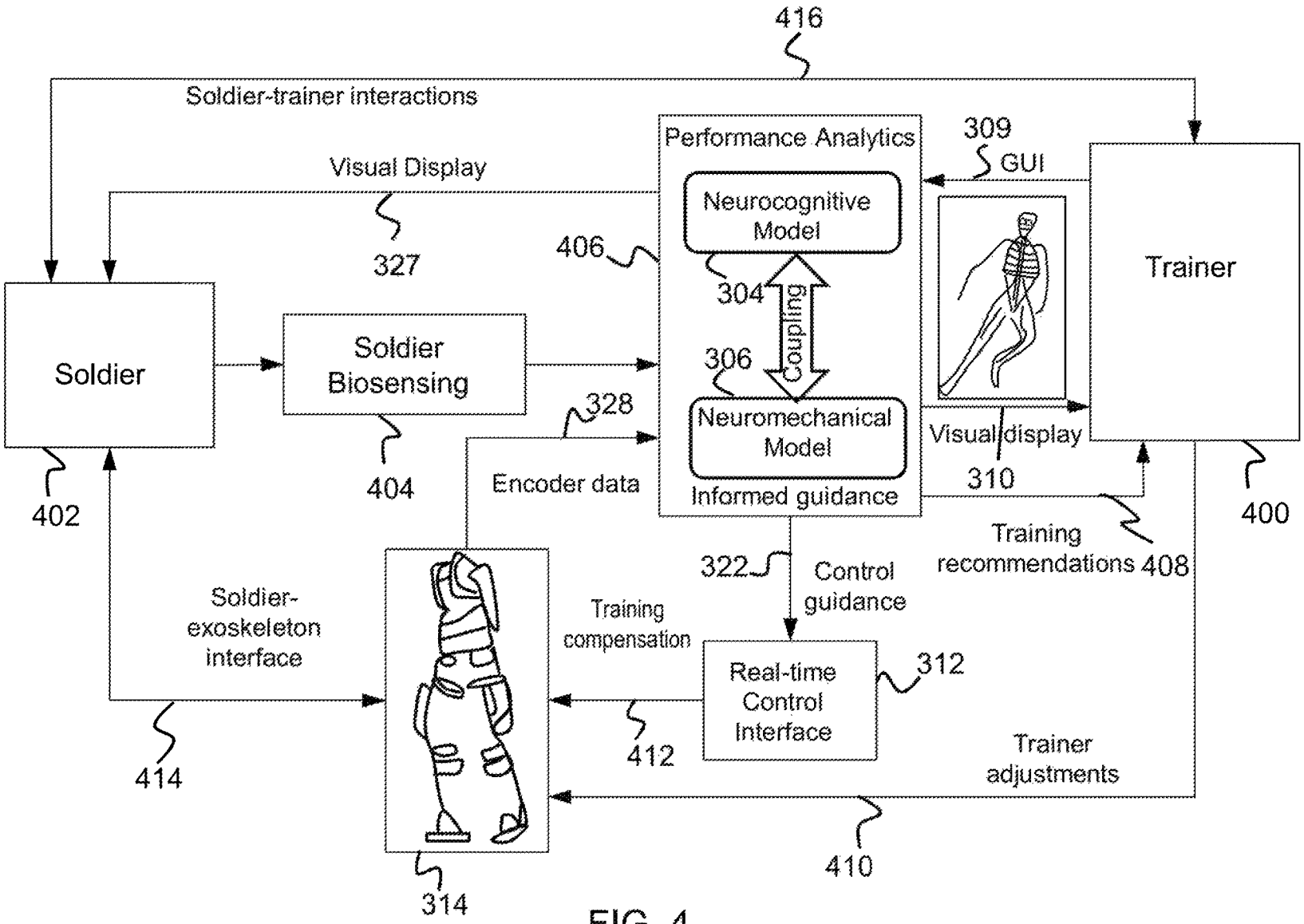
FIG. 4 is an illustration of training of soldiers using the system according to embodiments of the present invention.

The core components of biosensing sensing, predictive models, real-time control, and exoskeleton technologies of the system according to embodiments of the present invention can be applied to enhancing performance in able-bodied users, such as soldiers, in both training and real-world operations. FIG. 4 illustrates the core components depicted in FIG. 3 applied to enhancing performance of a soldier in a training operation. Therefore, rather than a physical therapist using the system to rehabilitate a patient, a trainer 400 is training a soldier 402. The same biosensing and analytics subsystems are employed, however control guidance is based on improving the soldier's performance during training rather than rehabilitating a patient. The soldier biosensing subsystem 404 streams soldier data in real-time to a performance analytics subsystem 406. Training recommendations 408 can be presented to the trainer 400 via the visual display 310, and the trainer 400 can then make appropriate trainer adjustments 410 to the exoskeleton 314. These may include modulating the relative balance between resistance and assistance generated by the exoskeleton.

Similar to the system designed for patient rehabilitation shown in FIG. 3, the control guidance 322 provided by the performance analytics subsystem 404 is input to the real-time control interface 312 which will provide training compensation 412 to the exoskeleton 314 based on improving training progress. This control guidance 322 will differ from the patient rehabilitation example in that physical pathologies will not be targeted. Rather, improved performance of able-bodied individuals will be targeted. The training compensation is intended to strengthen the soldier, reinforce proper technique in physical tasks, and improve overall performance in the field. Training process can be determined based on the physical therapist and metrics obtained through various sensors. For instance, in the lower limb, a pattern of gait can be assessed to provide guidance to the user. The metric in this example would be related to how abnormal (i.e., different) the gait is compared to normal. The metric could be determined via sensors within joints of the soldier-exoskeleton interface 414, or using inertial measurement unit (IMU) sensors attached to the clothing of a soldier (or patient) in the absence of the exoskeleton. Improvement could then be evaluated by assessing the user's gait as it returns to normal. A soldier-exoskeleton interface 414 and soldier-trainer interactions 416 replace like elements illustrated in FIG. 3.

Figure 5:
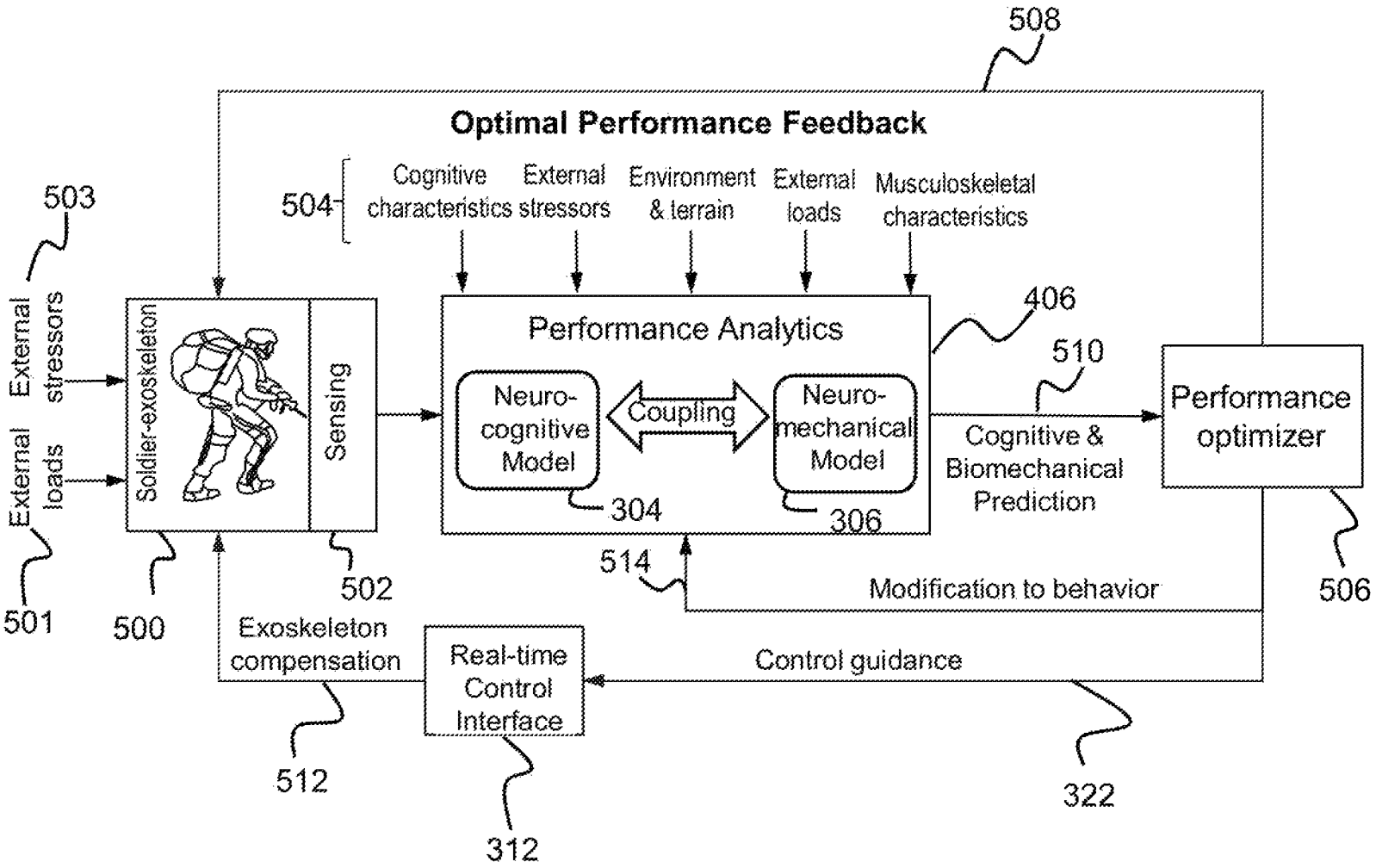
FIG. 5 is an illustration of an optimization subsystem according to embodiments of the present invention.

FIG. 5 illustrates an example of use of the present invention by a soldier in the field that is equipped with an exoskeleton (soldier-exoskeleton 500). Sensing 502 is integrated into the exoskeleton and is fed to the performance analytics subsystem 406. The sensors sense characteristics, such as external loads (e.g., backpack and equipment loads) 501 and external stressors (e.g., extreme temperature, humidity, and others factors that induce stress) 503. Based on situational performance characterization 504 (based on, for example, cognitive characteristics, external stressors, environment and terrain, external loads, and musculoskeletal characteristics), a performance optimizer subsystem 506 provides optimal performance feedback 508 to the soldier (in the form of visual or audible instructions) and control guidance 322 to the exoskeleton's real-time control interface 312. The real-time control interface 312 then adapts exoskeleton compensation 512 to the soldier-exoskeleton 500 accordingly. For instance, in an example involving a soldier in a battlefield, the soldier's fatigue could be characterized and optimal performance feedback 508 can be provided to the soldier. In this example, fatigue is determined via a reduced gait pattern involving changes in posture (e.g., crouch gait, greater knee flexion) and greater joint angle variability at the hip. The system according to embodiments of the present invention determines that the gait has changed through sensing 502 either integrated into the exoskeleton or connected with the soldier (e.g., IMUs attached to clothing) that measure biomechanical variables. The system then provides visual or audible instructions (i.e., control guidance 322) to the soldier through the real-time control interface 312 to, for instance, take a rest. Alternatively, if the case of a soldier-exoskeleton 500 arrangement, the control guidance 322 can provide exoskeleton compensation 512 directly to the exoskeleton to correct the soldier's gait pattern (e.g., slow it down) or provide more support to the soldier's knees via actuators in the joints of the exoskeleton which would to extend the soldier's gait and provide assistance. For example, the exoskeleton compensation 512 allows the solider to extend the distance traveled by providing support to the soldier's knees, versus no compensation.

Non-limiting examples of situational performance characterization 504 include cognitive characteristics, external stressors, environment and terrain characteristics, external loads, and musculoskeletal characteristics. The performance analytics subsystem 406, using coupled models of cognitive decision-making and neuromuscular biomechanics, sends cognitive and biomechanical predictions 510 to the performance optimizer subsystem 506. The algorithms that constitute the performance analytics subsystem 406 are disclosed in U.S. Non-Provisional application Ser. No. 14/538,350 and are also described in Literature Reference No. 14. In addition to providing control guidance 322, the performance optimizer subsystem 506 provides modifications to behavior 514 to the performance analytics subsystem 406.

As can be appreciated by one skilled in the art, the trainee may also be an athlete or other able-bodied person that could benefit from physical training. Therefore, any instance of "soldier" could easily be replaced with "athlete" or "user".

The present invention has multiple applications in rehabilitation therapy as well as improving soldier performance. For instance, the integrated platform described herein can be used to monitor and analyze patient progress in rehabilitation therapy for spinal cord injuries. Additionally, the system can be utilized to enhance wounded soldier performance and enhance performance of able-bodied soldiers. Further, the present invention is useful in characterizing the behavior of high performing individuals or enhancing the performance of low-performing individuals. The system can also be used to generate baseline soldier performance metrics for use in rehabilitation of soldiers.

The integrated platform according to various embodiments of the present invention can also be utilized to address mental issues relating to motivation in therapy. For example, referring to FIG. 3, patients 316 frequently try to cheat or under-exert themselves during difficult therapy sessions, resulting in slower progress. Periods of low motivation or effort may be identified with the present invention. Using estimates of the patient's emotional state and motivation level from, for example, galvanic skin response (GSR) sensors which indicate psychological arousal as determined by the patient biosensing subsystem 300, support or break-time may be recommended (i.e., therapy recommendations 318). Triggering of the break-time is based on a combination of the biosensing to objectively determine levels of stress, frustration, and/or boredom (lack of motivation) and the physical therapist's subjective experience in prescribing changes in therapy protocols given these emotional states. The therapist can suggest thresholds based on experience. Coupled with the participation of a physical therapist 308, the system described herein addresses the cognitive aspects of rehabilitation by utilizing neurocognitive patient analytics subsystems 302 and by making inferences about patient motivation from physiological sensing via the patient biosensing subsystem 300. Combined with physical information from the patient analytics subsystem 302, the physical therapist 308 will be able to provide unprecedented rehabilitation guidance to the injured warfighter.

In summary, the system described herein is an integrated platform to monitor and analyze individual progress in physical and cognitive tasks, with utility in rehabilitation therapy for spinal cord injuries, as an example. Lower limb and gait rehabilitation is critical because battlefield injuries, particularly those resulting in spinal cord damage, frequently have severe impact on the lower extremities. Lower limb rehabilitation techniques have not advanced at the rate of upper limb rehabilitation techniques used primarily in stroke recovery. Unlike rehabilitation for upper limb motion, for which seated postures can allow isolation of the upper extremities, rehabilitation for walking involves complex interactions from the entire body and an understanding of the interactions between the sensory input and motor output that dictate gait behavior.

The integrated platform according to embodiments of the invention can be used alongside a robotic exoskeleton, augmenting the role of the physical therapist or trainer. The present invention is motivated by recognition of the vital role of the physical therapist in-patient rehabilitation. The therapist's role is enhanced by providing him or her with online feedback regarding patient progress which has proven difficult to characterize. Specifically, recent advances in neurocognitive and neuromechanical modeling are applied to provide the therapist (or other trained professional) with rich feedback in real-time, reducing uncertainty and allowing the therapist to make informed decisions to optimize patient treatment. The physical therapist also does not need to frequently gage variables which are often difficult to quantify, such as patient fatigue or level of engagement and motivation. Moreover, additional biomechanical variables, such as joint motion, ground and joint reaction forces, muscle and tendon forces, which are highly relevant to the work of the therapist, are now presented to him or her for consideration in therapy. Finally, the therapist is provided with online sensor and model-based characterizations of patient performance

What is claimed is:

1. A system for assessing individual progress in physical and cognitive tasks, the system comprising:

one or more processors and a non-transitory computer-readable medium having executable instructions encoded thereon such that when executed, the one or more processors perform an operation of:

sensing, with a biosensing subsystem, cognitive and biomechanical states of a user based on output of a plurality of sensors, resulting in a set of cognitive data and a set of biomechanical data;

generating a predictive model of cognitive performance using the set of cognitive data;

performing a neuromechanical simulation in an analytics subsystem using the set of biomechanical data, resulting in generated estimates of hidden biomechanical state variables;

generating a predictive model of biomechanical performance;

comparing the set of biomechanical data and the estimates of hidden biomechanical state variables with archived user data;

using the predictive model of cognitive performance and the predictive model of biomechanical performance, determining a physiological state of the user;

generating real-time performance feedback from the predictive model of cognitive performance and the predictive model of biomechanical performance;

generating control guidance based on the real-time performance feedback and the physiological state of the user; and sending the control guidance through a real-time control interface to induce a user motion.

2. The system as set forth in claim 1, wherein the control guidance is sent to a robotic exoskeleton worn by the user to adjust the user's motions.

3. The system as set forth in claim 1, wherein the analytics subsystem comprises a neurocognitive model and a neuromechanical model implemented within a simulation engine to process the set of biomechanical data and predict a therapeutic outcome.

4. The system as set forth in claim 3, wherein the neurocognitive model is configured to acquire data from the biosensing subsystem, generate cognitive state estimates, and predict cognitive performance of the user.

5. The system as set forth in claim 3, wherein the therapeutic outcome is predicted by comparing the set of biomechanical data and the estimates of hidden biomechanical state variables with previous biomechanical information to generate a performance metric.

6. The system as set forth in claim 1, wherein the analytics subsystem is accessible via the visual display.

7. The system as set forth in claim 6, wherein the visual display displays a reference avatar representing the user's current motion and a goal avatar representing a future motion of the user, wherein the goal avatar is overlaid with the reference avatar on the visual display.

8. The system as set forth in claim 1, wherein at least one recommendation is presented via the visual display to recommend appropriate adjustments to the control guidance.

9. A computer-implemented method for assessing individual progress in physical and cognitive tasks, comprising:

an act of causing one or more processors to execute instructions stored on a non-transitory memory such that upon execution, the one or more processors perform operations of:

sensing, with a biosensing subsystem, cognitive and biomechanical states of a user based on output of a plurality of sensors, resulting in a set of cognitive data and a set of biomechanical data;

generating a predictive model of cognitive performance using the set of cognitive data;

performing a neuromechanical simulation in an analytics subsystem using the set of biomechanical data, resulting in generated estimates of hidden biomechanical state variables;

generating a predictive model of biomechanical performance;

comparing the set of biomechanical data and the estimates of hidden biomechanical state variables with archived user data;

using the predictive model of cognitive performance and the predictive model of biomechanical performance, determining a physiological state of the user;

generating real-time performance feedback from the predictive model of cognitive performance and the predictive model of biomechanical performance;

generating control guidance based on the real-time performance feedback and the physiological state of the user; and sending the control guidance through a real-time control interface to induce a user motion.

10. The method as set forth in claim 9, wherein the control guidance is sent to a robotic exoskeleton worn by the user to adjust the user's motions.

11. The method as set forth in claim 9, wherein the analytics subsystem comprises a neurocognitive model and a neuromechanical model implemented within a simulation engine to process the set of biomechanical data and predict a therapeutic outcome.

12. The method as set forth in claim 9, wherein the analytics subsystem is accessible via the visual display.

13. The method as set forth in claim 12, wherein the visual display displays a reference avatar representing the user's current motion and a goal avatar representing a future motion of the user, wherein the goal avatar is overlaid with the reference avatar on the visual display.

14. The method as set forth in claim 9, wherein at least one recommendation is presented via the visual display to recommend appropriate adjustments to the control guidance.

15. A computer program product for assessing individual progress in physical and cognitive tasks, the computer program product comprising computer-readable instructions stored on a non-transitory computer-readable medium that are executable by a computer having one or more processors for causing the processor to perform the operations of:

sensing, with a biosensing subsystem, cognitive and biomechanical states of a user based on output of a plurality of sensors, resulting in a set of cognitive data and a set of biomechanical data;

generating a predictive model of cognitive performance using the set of cognitive data;

performing a neuromechanical simulation in an analytics subsystem using the set of biomechanical data, resulting in generated estimates of hidden biomechanical state variables;

generating a predictive model of biomechanical performance;

comparing the set of biomechanical data and the estimates of hidden biomechanical state variables with archived user data;

using the predictive model of cognitive performance and the predictive model of biomechanical performance, determining a physiological state of the user;

generating real-time performance feedback from the predictive model of cognitive performance and the predictive model of biomechanical performance;

generating control guidance based on the real-time performance feedback and the physiological state of the user; and sending the control guidance through a real-time control interface to induce a user motion.

16. The computer program product as set forth in claim 15, wherein the control guidance is sent to a robotic exoskeleton worn by the user to adjust the user's motions.

17. The computer program product as set forth in claim 15, wherein the analytics subsystem comprises a neurocognitive model and a neuromechanical model implemented within a simulation engine to process the set of biomechanical data and predict a therapeutic outcome.

18. The computer program product as set forth in claim 15, wherein the analytics subsystem is accessible via the visual display.

19. The computer program product as set forth in claim 18, wherein the visual display displays a reference avatar representing the user's current motion and a goal avatar representing a future motion of the user, wherein the goal avatar is overlaid with the reference avatar on the visual display.

20. The computer program product as set forth in claim 15, wherein at least one recommendation is presented via the visual display to recommend appropriate adjustments to the control guidance.

* * * * *